US010391020B2

(12) United States Patent
Bymers et al.

(10) Patent No.: US 10,391,020 B2
(45) Date of Patent: Aug. 27, 2019

(54) ARM THERAPY DEVICE

(71) Applicant: Bymers and Johnson Therapeutic Interventions, LLC, Alexandria, MN (US)

(72) Inventors: Brian Con Bymers, Alexandria, MN (US); Shawn P. Johnson, Alexandria, MN (US)

(73) Assignee: Bymers and Johnson Therapeutic Interventions, LLC, Alexandria, MN (US)

( * ) Notice: Subject to any disclaimer, the term of this patent is extended or adjusted under 35 U.S.C. 154(b) by 813 days.

(21) Appl. No.: 14/959,061

(22) Filed: Dec. 4, 2015

(65) Prior Publication Data

US 2017/0156968 A1 Jun. 8, 2017

(51) Int. Cl.
*A61H 15/00* (2006.01)

(52) U.S. Cl.
CPC ..... *A61H 15/00* (2013.01); *A61H 2015/0014* (2013.01); *A61H 2201/1261* (2013.01); *A61H 2201/1635* (2013.01)

(58) Field of Classification Search
CPC .... A61H 2015/0021; A61H 2015/0057; A61H 15/00; A61H 2201/1635; A61H 2015/0014; A61H 2201/1261
See application file for complete search history.

(56) References Cited

U.S. PATENT DOCUMENTS

| | | | | |
|---|---|---|---|---|
| 2,230,890 | A * | 2/1941 | McClenathen | A61H 15/00 482/79 |
| 3,583,396 | A | 6/1971 | Landis | |
| 3,759,250 | A | 9/1973 | Salata | |
| 5,643,182 | A | 7/1997 | Engel | |
| 6,033,372 | A | 3/2000 | Tarbet | |
| 2005/0159688 | A1 | 7/2005 | Sakamoto | |
| 2010/0063429 | A1* | 3/2010 | McClorey | A61H 15/00 601/122 |
| 2010/0274165 | A1 | 10/2010 | Evans | |
| 2012/0203151 | A1* | 8/2012 | Kleiman | A61H 15/00 601/112 |
| 2013/0123078 | A1 | 5/2013 | Marji | |
| 2017/0020771 | A1* | 1/2017 | Shannon | A61H 15/00 |
| 2017/0258671 | A1* | 9/2017 | Turner | A61H 7/008 |

* cited by examiner

*Primary Examiner* — Steven O Douglas
(74) *Attorney, Agent, or Firm* — Neustel Law Offices

(57) ABSTRACT

An arm therapy device for the prevention and treatment of repetitive stress injuries of the elbow, forearm, and wrist. The arm therapy device generally includes a housing adapted to be freestanding in an upright manner. The housing includes an upper opening which provides access to the interior of the housing. Rollers across the interior of the housing comprising pairs of rollers which are biased inwardly toward each other. Bias members such as resistance bands may be utilized to bias each pair of rollers toward each other. Collars may be utilized on the rollers to which the bias members are connected. By using the present invention, one may treat a limb such as an arm without having to support the housing with another hand or another person. As the limb passes through the housing, the rollers will exert pressure on the limb which aids in treating or preventing repetitive stress injuries.

16 Claims, 9 Drawing Sheets

ARM THERAPY DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a therapeutic device and more specifically it relates to an arm therapy device for the prevention and treatment of repetitive stress injuries of the elbow, forearm, and wrist such as carpal tunnel, tennis elbow, pain, numbness, and weakness.

Description of the Related Art

Any discussion of the related art throughout the specification should in no way be considered as an admission that such related art is widely known or forms part of common general knowledge in the field.

In the modern age of computers, repetitive stress injuries of the lower arm are becoming more and more common among the general public. Similarly, athletes will often experience acute or chronic pain of the lower arm or wrist. Previously, various methods and devices of treatment have been offered to deal with such injuries.

However, each of these methods and devices suffers from a number of shortcomings. Handheld rollers typically either require that an individual awkwardly hold the device in their other hand or enlist the aid of a second person to hold the device as therapy is applied. In patients with injuries on both of their arms or hands, these handheld rollers can actually further aggravate the injury of the hand and arm that are supporting the rollers as treatment is being applied to the other hand or arm.

Traditional physical therapy, such as massage or neuromuscular therapy, is effective but expensive and time-consuming. Previous spring-loaded systems also offer less arm contact and typically require a table or other surface. Other devices are clumsy to use and instable, even when placed on a flat surface such as a table.

Because of the inherent problems with the related art, there is a need for a new and improved arm therapy device for the prevention and treatment of repetitive stress injuries of the elbow, forearm, and wrist such as carpal tunnel, tennis elbow, pain, numbness, and weakness.

BRIEF SUMMARY OF THE INVENTION

Provided herein is an arm therapy device which includes a housing adapted to be freestanding in an upright manner. The housing includes an upper opening which provides access to the interior of the housing. A plurality of rollers extend across the interior of the housing comprising pairs of rollers which are biased inwardly toward each other. Bias members such as resistance bands may be utilized to bias each pair of rollers toward each other. Collars may be utilized on the rollers to which the bias members are connected. By using the present invention, one may treat a limb such as an arm without having to support the housing with another hand or another person. As the limb passes through the housing, the rollers will exert pressure on the limb which aids in treating or preventing repetitive stress injuries.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
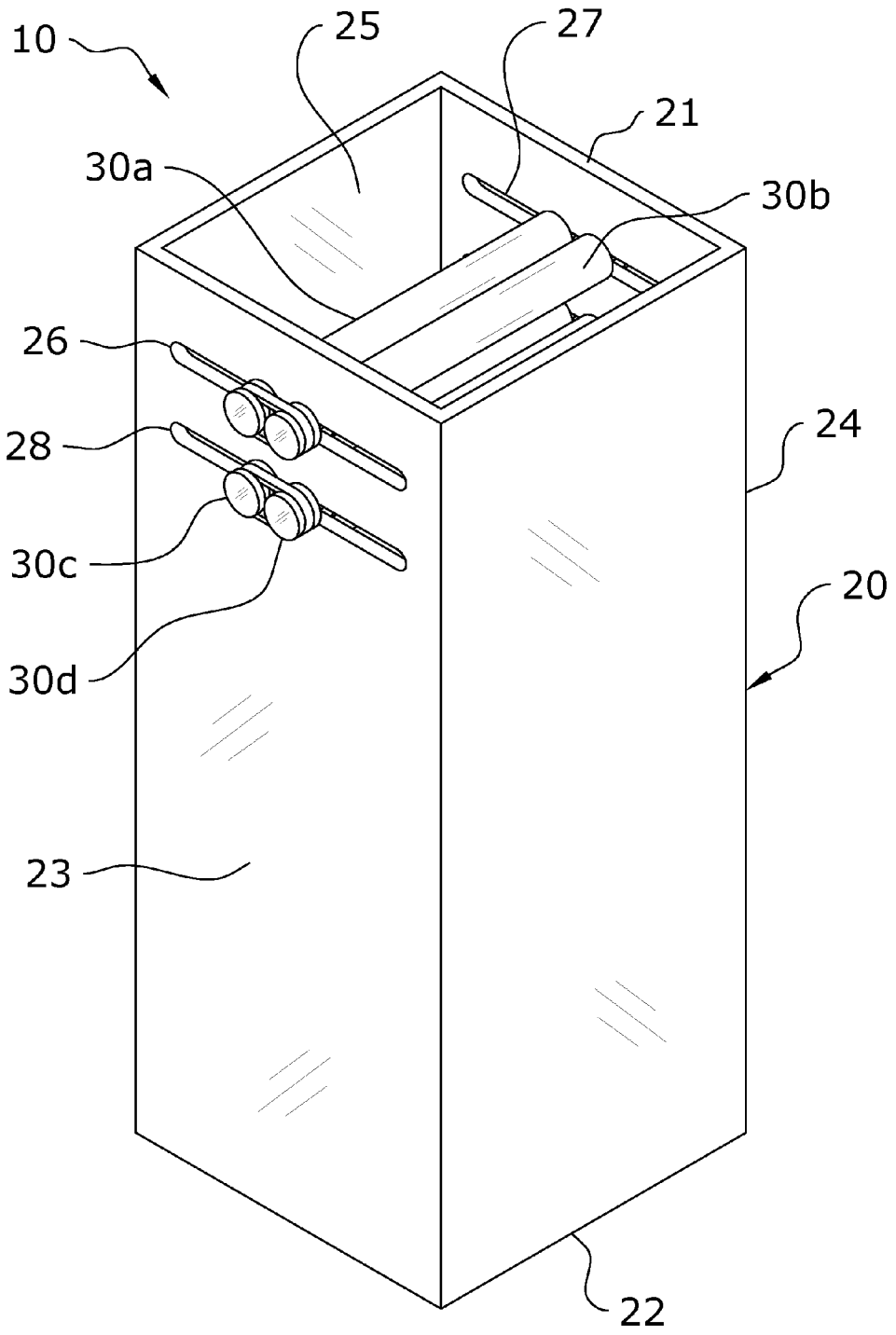
FIG. 1 is an upper perspective view of the present invention.

A. Overview.

Turning now descriptively to the drawings, in which similar reference characters denote similar elements throughout the several views, FIGS. 1 through 10 illustrate an arm therapy device 10, which comprises a housing 20 adapted to be freestanding in an upright manner. The housing 20 includes an upper opening 25 which provides access to the interior of the housing 20. A plurality of rollers 30 extend across the interior of the housing 20 comprising pairs of rollers 30 which are biased inwardly toward each other. Bias members 50 such as resistance bands may be utilized to bias each pair of rollers 30 toward each other. Collars 40 may be utilized on the rollers 30 to which the bias members 50 are connected. By using the present invention, one may treat a limb 12 such as an arm without having to support the housing 20 with another hand or another person. As the limb 12 passes through the housing 20, the rollers 30 will exert pressure on the limb 12 which aids in treating or preventing repetitive stress injuries.

B. Housing.

Figure 2:
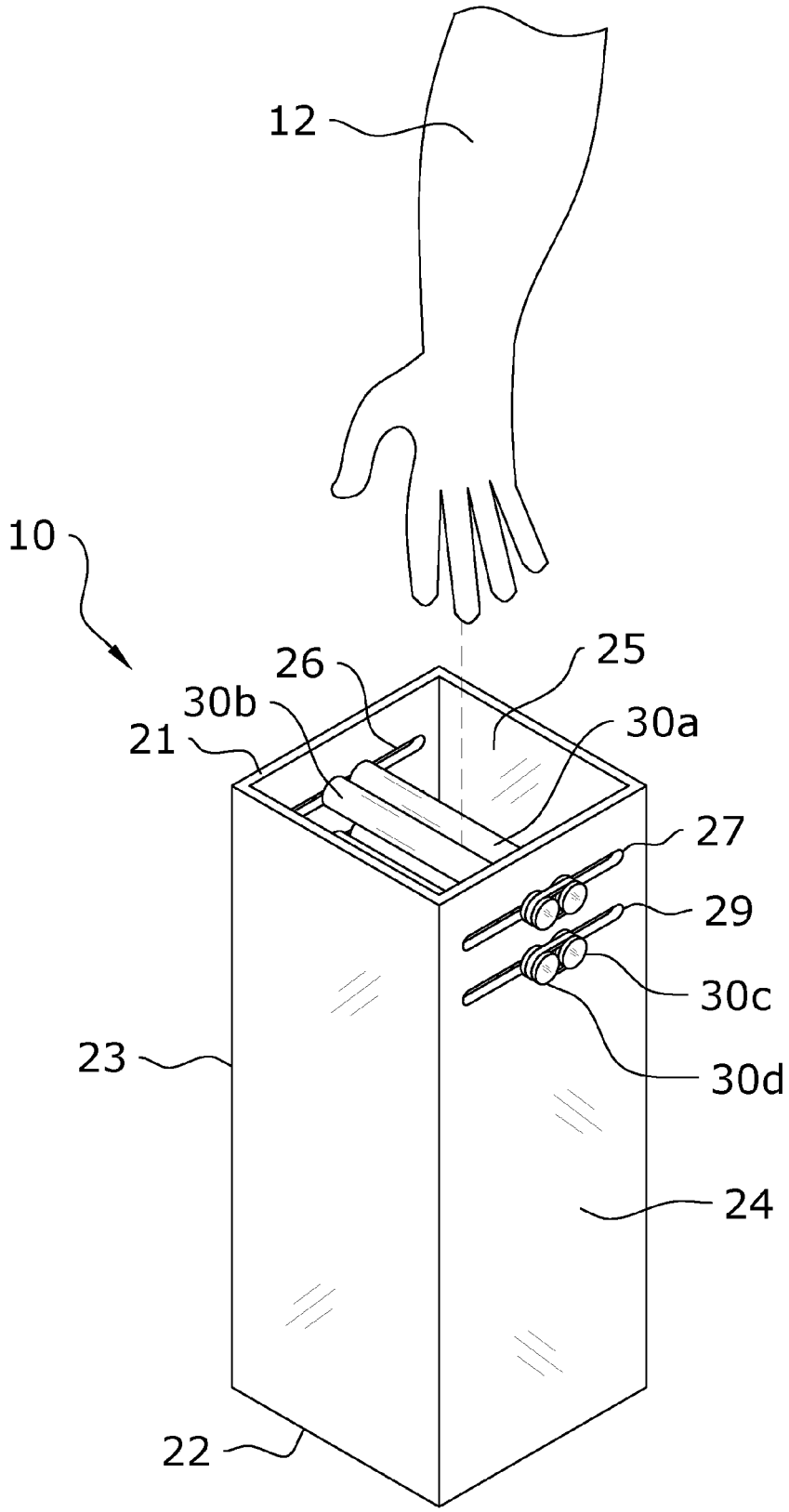
FIG. 2 is an upper perspective view of an arm aligned for insertion into the present invention for treatment.
Figure 3:
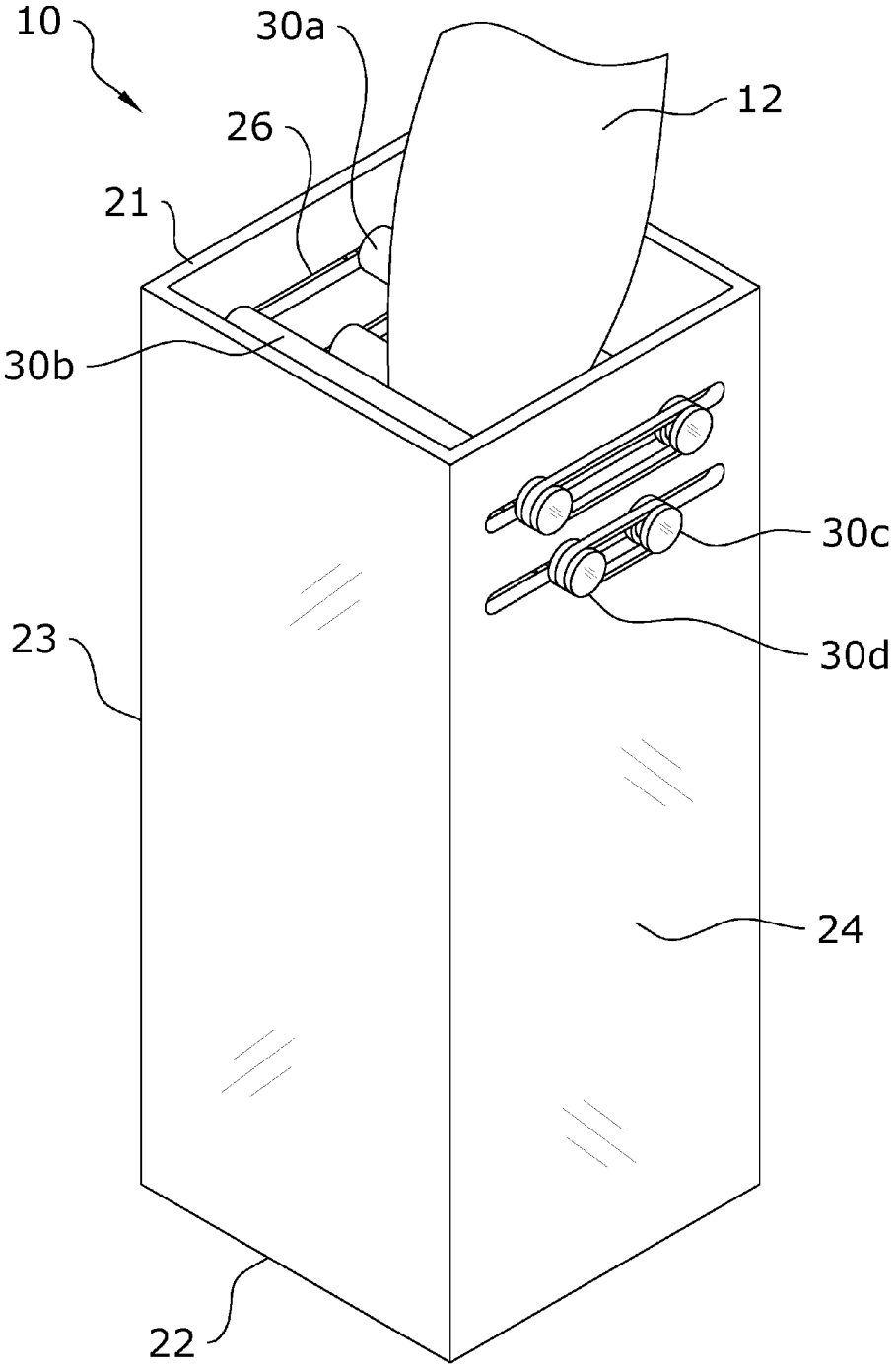
FIG. 3 is an upper perspective view of an arm positioned within the present invention for treatment.
Figure 4:
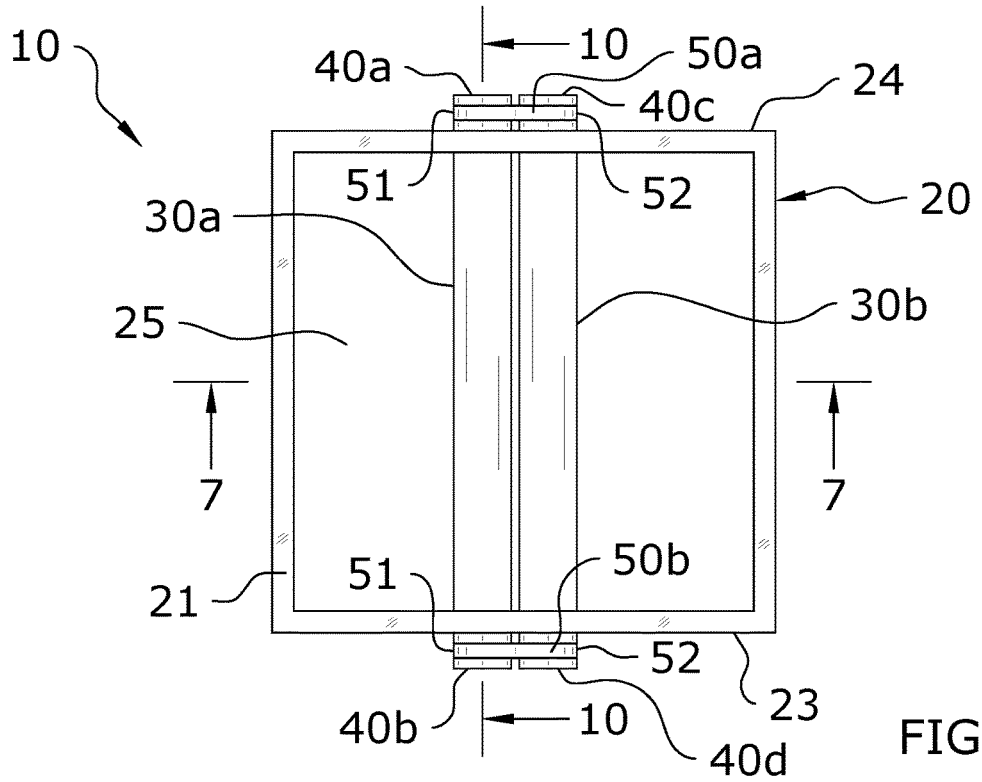
FIG. 4 is a top view of the present invention with the rollers in their resting position.
Figure 5:
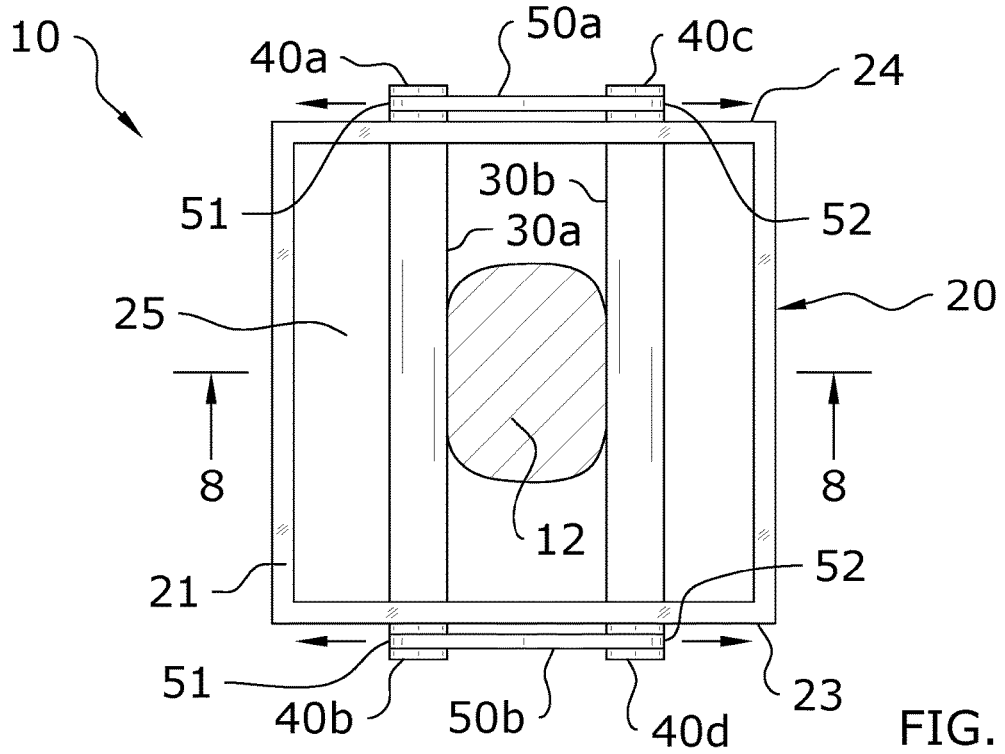
FIG. 5 is a top view of the present invention illustrating an arm positioned between the rollers.
Figure 6:
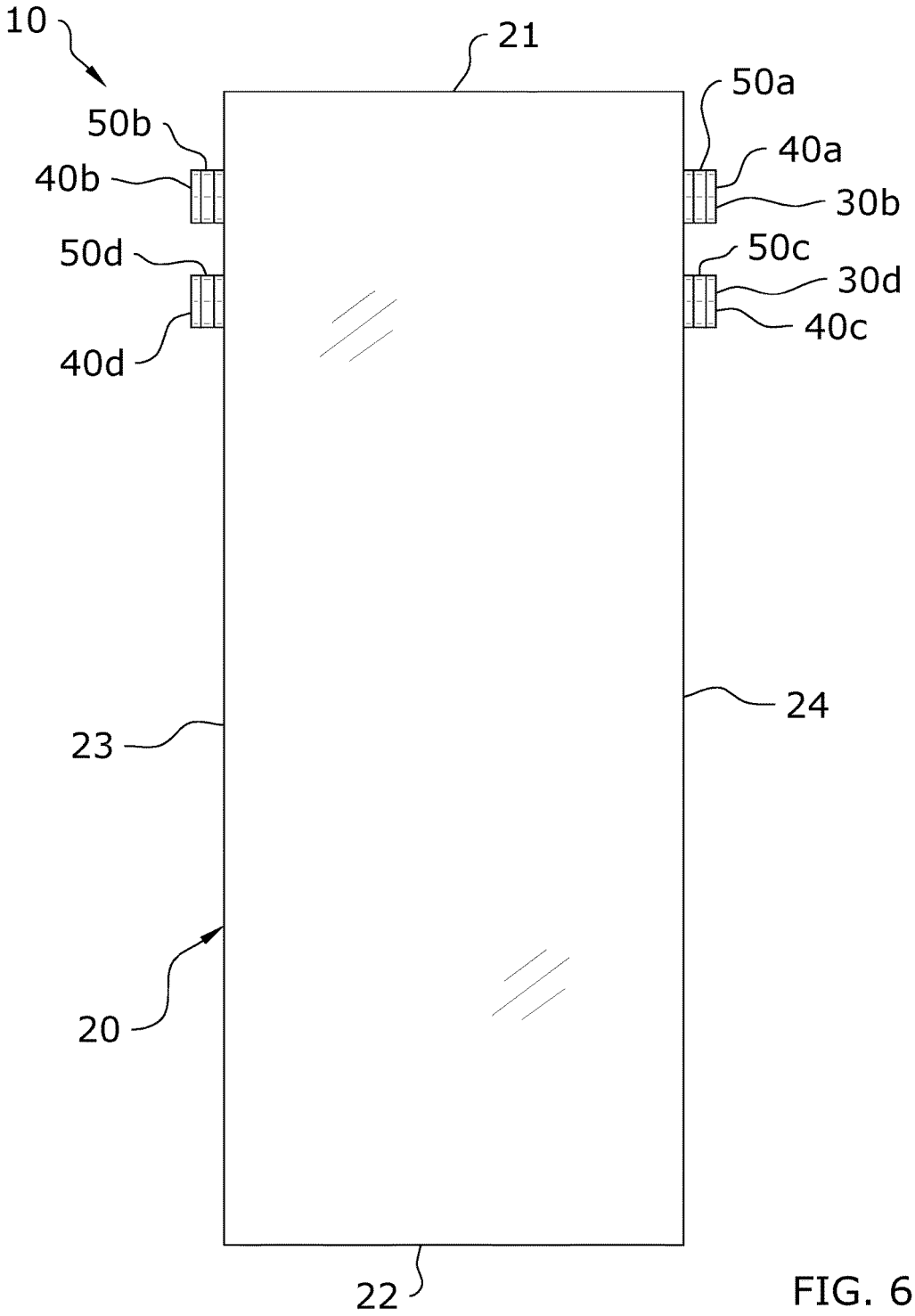
FIG. 6 is a frontal view of the present invention.
Figure 7:
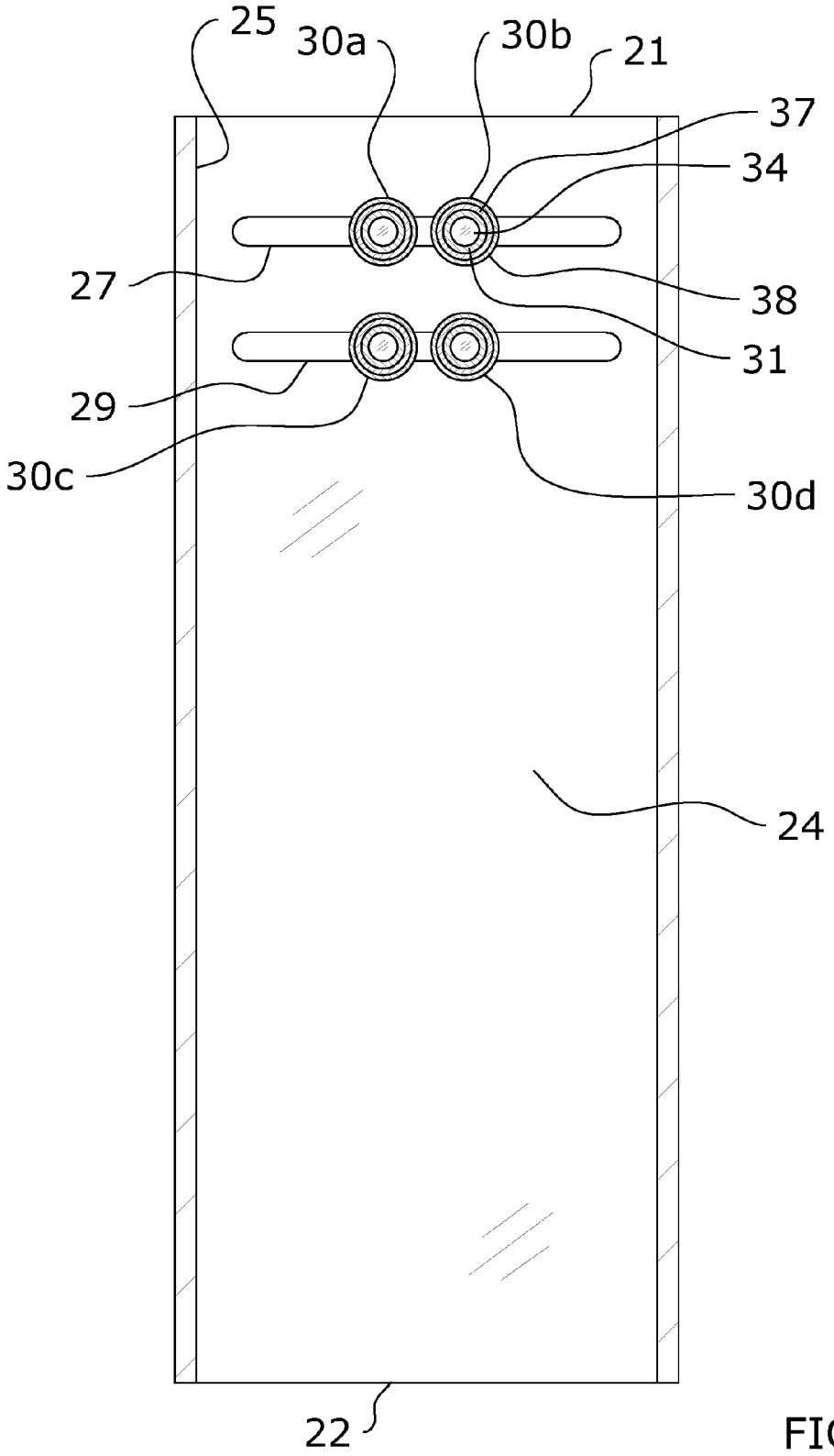
FIG. 7 is a side view of the present invention.

As best shown in FIGS. 1-3, the present invention generally comprises a housing 20 which is adapted to be freestanding without external support. The exemplary figures illustrate a preferred embodiment in which the housing 20 comprises an elongated rectangular configuration including an upper end 21, a lower end 22, a first side 23, and a second side 24.

It should be appreciated, however, that the shape, size, configuration, and orientation of the housing 20 may vary in different embodiments of the present invention, and thus should not be construed as limited by the exemplary embodiment shown and described herein. The housing 20 will preferably be freestanding on its lower end 22 in a vertical orientation, but may be positioned in any orientation (such as a horizontal orientation by resting on its first side 23) so long as access is provided to the upper opening 25 for treatment. The housing 20 may also be transparent in some embodiments of the present invention.

As shown in FIG. 1, the housing 20 includes an upper opening 25 which provides access to the interior of the housing 20. In preferred embodiments, the housing 20 will be hollow so that the arm 12 may be inserted therein when the present invention is in use. It should be appreciated, however, that the housing 20 need not be completely hollow as shown and instead may include a chamber, cavity, or the like formed within the housing 20 which is accessed through the upper opening 25.

As best shown in FIGS. 1 and 2, the housing 20 includes a plurality of slots 26, 27, 28, 29 in which rollers 30 are slidably positioned. The number, positioning, orientation, and configuration of the slots 26, 27, 28, 29 may vary in different embodiments and should not be construed as limited by the exemplary embodiment shown in the figures.

In the preferred embodiment shown in the figures, each roller 30 utilizes a pair of slots 26, 27. In some embodiments, each roller 30 may require only a single slot 26. In either case, each of the slots 26, 27, 28, 29 extend across one of the sides 23, 24 of the housing 20 in a horizontal, diagonal, or vertical orientation.

As best shown in FIGS. 1 and 2, a preferred embodiment of the present invention, which is in no way limiting, comprises a first upper slot 26 extending across the first side 23 of the housing 20 and a second upper slot 27 extending across the second side 24 of the housing 20. The first upper slot 26 and second upper slot 27 are preferably aligned so that rollers 30 may extend horizontally between the two upper slots 26, 27 as shown in FIG. 1. In some embodiments as mentioned above, other orientations may be utilized.

In the preferred embodiment as shown in FIGS. 1 and 2, a first lower slot 28 extends across the first side 23 of the housing 20 at a position below the first upper slot 26. A second lower slot 29 similarly extends across the second side 24 of the housing 20 at a position below the second upper slot 27. The lower slots 28, 29 will preferably be aligned with each other for a horizontal orientation of the rollers 30, but other configurations may be utilized.

The distance between the upper slots 26, 27 and the lower slots 28, 29 may vary in different embodiments of the present invention. In some embodiments, the lower slots 28, 29 may be omitted. In other embodiments, additional slots 26, 27, 28, 29 may be added to accommodate additional rollers 30. The present invention should in no way be construed as limited to the use of four rollers 30 as shown in the exemplary figures, as more or less may be utilized for different levels of treatment.

C. Rollers.

As shown throughout the figures, the housing 20 may include two or more rollers 30 which extend across the housing 20. Rollers 30 will preferably be utilized in pairs, with each pair of rollers 30 being biased toward each other. By positioning a limb such as an arm 12 between the rollers 30, one can advance and retract the limb so that the rollers 30 provide treatment due to the inwardly-biased force provided by the bias members 50.

The figures illustrate the rollers 30 as comprising an elongated configuration having a first end 32 and a second end 33. In a preferred embodiment as shown in the figures, each of the rollers 30 comprises a tubular configuration having a channel 34 extending therethrough. In some embodiments, the rollers 30 may be solid except for depressions at either end 32, 33 in which the collars 40 are removably connected.

In the preferred embodiment shown in the figures, each of the rollers 30 comprise an inner tube 31 and an outer tube 37 positioned around the inner tube 31 such that the outer tube 37 may freely rotate with respect to the inner tube 31. In a preferred embodiment, PVC pipes may be used for the inner and outer tubes 31, 37, though other configurations may be utilized. The outer tube 37 may include an outer foam 38 such as rubber.

Each of the rollers 30 preferably extends across the interior of the housing 20 as shown in the figures. As mentioned previously, the rollers 30 may extend horizontally as shown in the figures, or in any other orientation in other embodiments. Preferably, a first end 32 of each roller 30 is rotatably and slidably positioned within a first slot 26, 28 and a second end 33 of each roller 30 is rotatably and slidably positioned within a second slot 27, 29. The rollers 30 will preferably rotate within the slots 26, 27, 28, 29, though in some embodiments they may be configured not to rotate so as to provide additional friction to the limb 12 being treated.

As shown throughout the figures, the rollers 30 may include threading 35, 36 which is adapted to removably engage with corresponding threading on the connectors 45 of the collars 40. In a preferred embodiment, each roller 30 includes a first roller threading 35 at its first end 32 and a second roller threading 36 on its second end 33. The roller threading 35, 36 is generally internal to the rollers 30 such that the rollers 30 are the female in the male-female engagement with the collars 40 (i.e., threaded openings). It should be appreciated, however, that in some embodiments the collars 40 may be fixedly attached or integral with the rollers 30, and thus threading 35, 36 may be omitted.

As shown throughout the figures, each of the rollers 30 may include an outer foam 38 surrounding its outer surface. The outer foam 38 may comprise any type of material which will aid in comfort when using the present invention, such as rubber. Any soft or malleable material will generally suffice for the outer foam 38. In some embodiments, the outer foam 38 may be integral with the rollers 30. In other embodiments, the outer foam 38 may be connected, such as by an adhesive or by friction-fitting so that the outer foam 38 may be easily removed and replaced if needed.

D. Collars and Bias Members.

As shown throughout the figures, each of the rollers 30 may include one or more collars 40. While the rollers 30 are substantially internal to the housing 20, the collars 40 are generally connected to the outside of the housing 20. In a preferred embodiment as shown in the figures, each roller 30 includes a first collar 40*a* at its first end 32 and a second collar 40*b* at its second end 33. In some embodiments, a single collar 40 may be utilized for each roller 30.

Figure 9:
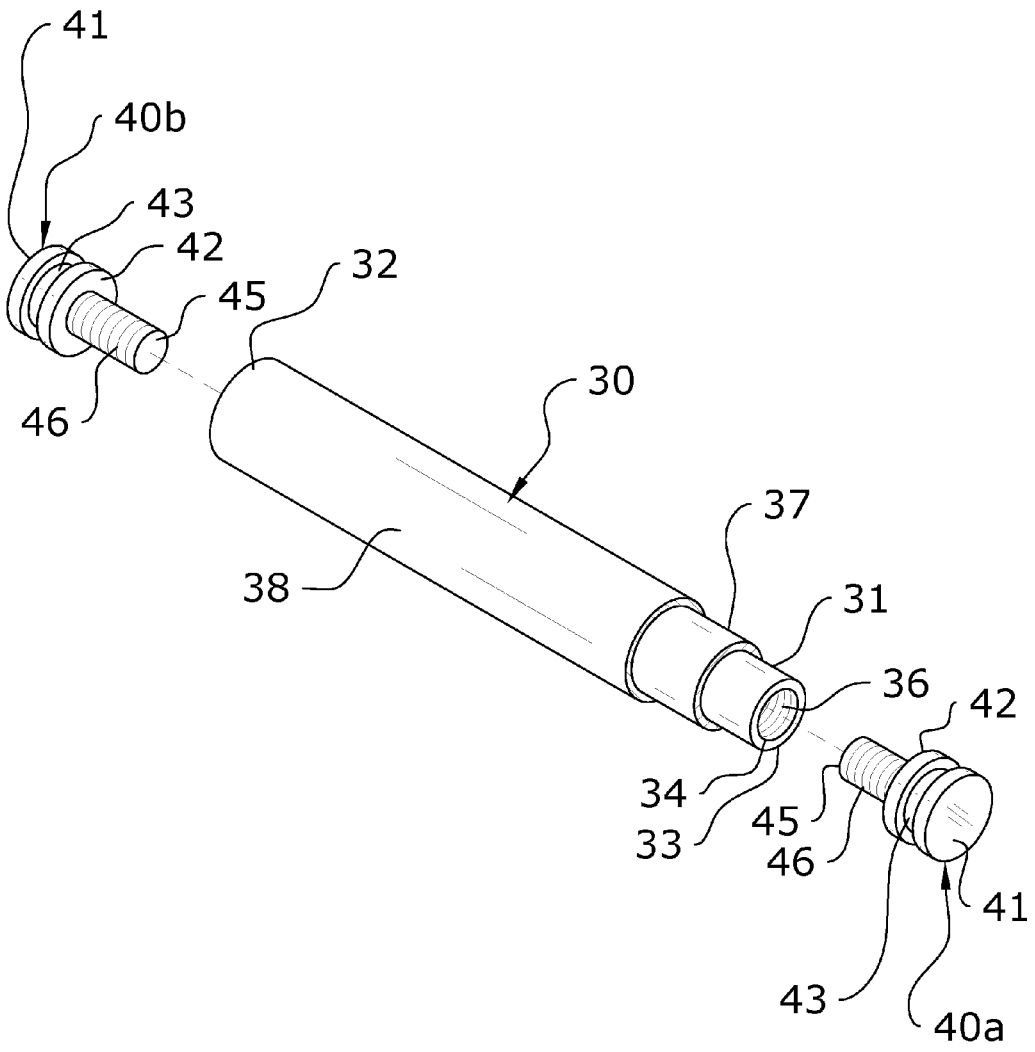
FIG. 9 is an upper perspective view of an exemplary embodiment of a roller for use with the present invention.
Figure 10:
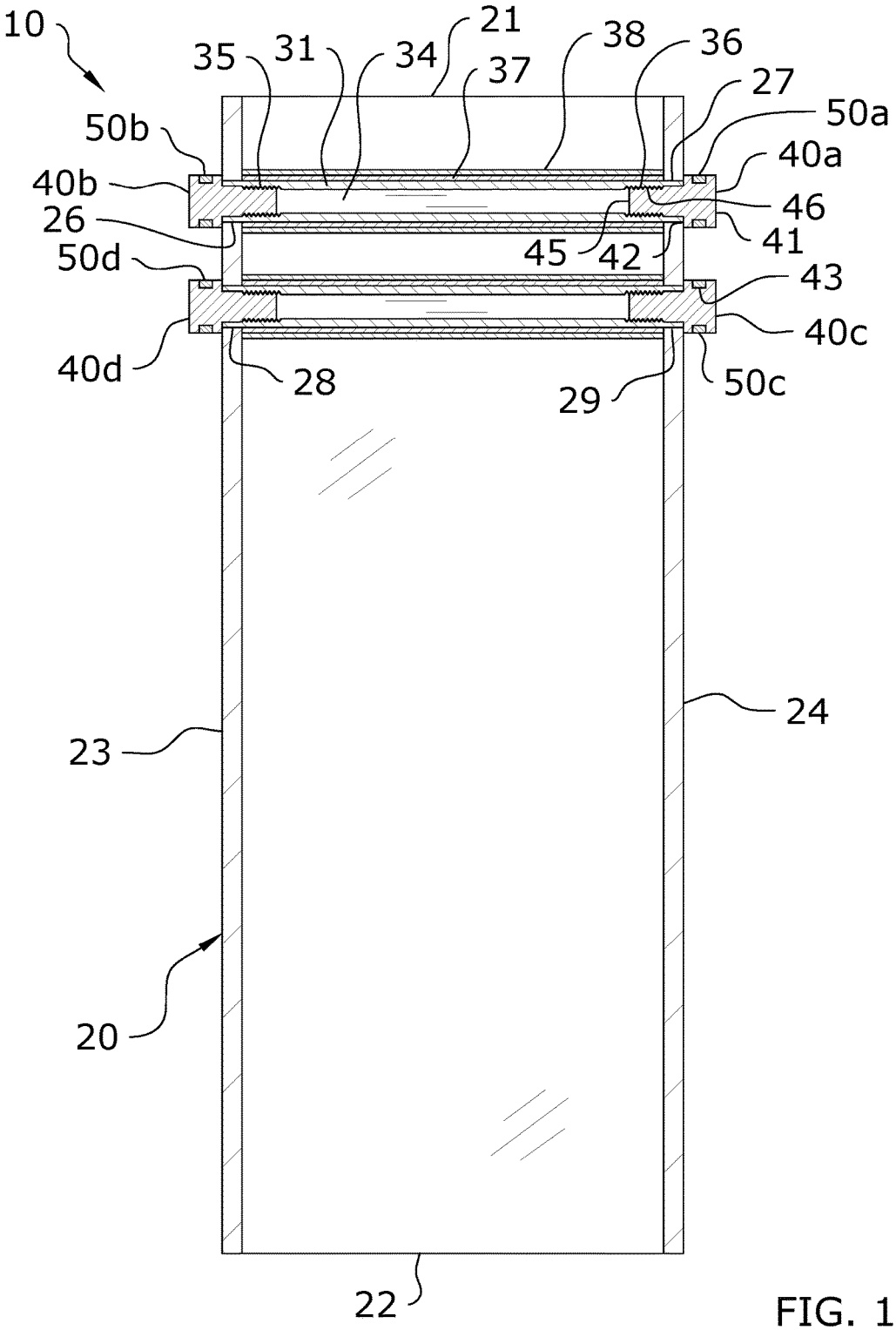
FIG. 10 is a frontal sectional view of the present invention.

As best shown in FIG. 9, each of the collars 40 comprises an outer end 41 and an inner end 42. The outer end 41 faces away from the housing 20 while the inner end 42 faces toward the housing 20. A groove 43 is formed between the outer and inner ends 41, 42 of the collar 40. The bias members 50 of the present invention may be connected around the collars 40 using the groove 43 as shown throughout the figures. The shape, size, and orientation of the groove 43 may thus vary for different types of bias members 50.

Each collar 40 may include a connector 45 extending from its inner end 42 as shown in FIG. 9. The connector 45 extends through the slots 26, 27, 28, 29 to connect the collar 40 with one of the rollers 30. In a preferred embodiment as shown in the figures, the connector 45 includes collar threading 46 which engages with the roller threading 35, 36 of the rollers 30 to removably connect the collars 40 to the rollers 30.

FIGS. 1 and 2 illustrate a preferred embodiment of the present invention. In this embodiment, a first roller 30*a* and a second roller 30*b* extend between the upper slots 26, 27 of the housing 20. A third roller 30*c* and a fourth roller 30*d* extend between the lower slots 28, 29 of the housing 20. A first collar 40*a* and a second collar 40*b* are attached on either end 32, 33 of the first roller 30*a*. A third collar 40*c* and a fourth collar 40*d* are attached on either end 32, 33 of the second roller 30*b*. The third and fourth rollers 30*c*, 30*d* similarly each include a pair of collars 40.

It should be appreciated that the foregoing is merely an exemplary embodiment of the present invention. More or less rollers 30 or collars 40 may be utilized for different types of applications of the present invention. More rollers 30 may be necessary for injuries which cover more of the limb 12, whereas less rollers 30 may be necessary for injuries that are more limited in location.

As shown throughout the figures, each pair of rollers 30 within a slot 26, 27, 28, 29 are connected to each other by a bias member 50. Each pair of rollers 30 is biased inwardly by the bias member 50 so that, absent force, the rollers 30 rest next to each other. This ensures that inward resistance is applied to the limb 12 as it separates the rollers 30 during treatment. While various types of bias members 50 may be utilized, a preferred embodiment of the present invention utilizes resistance bands which are connected at a first end 51 to a first roller 30*a* and at a second end 52 to a second roller 30*b*.

E. Operation of Preferred Embodiment.

In use, the housing 20 is first positioned upright by placing its lower end 22 on a surface such as a table as shown in FIG. 1. The housing 20 is configured to be freestanding so that no outside support is necessary during use. With the housing 20 so positioned, the upper opening 25 of the housing 20 is easily accessible by standing over or sitting next to the housing 20.

Figure 8:
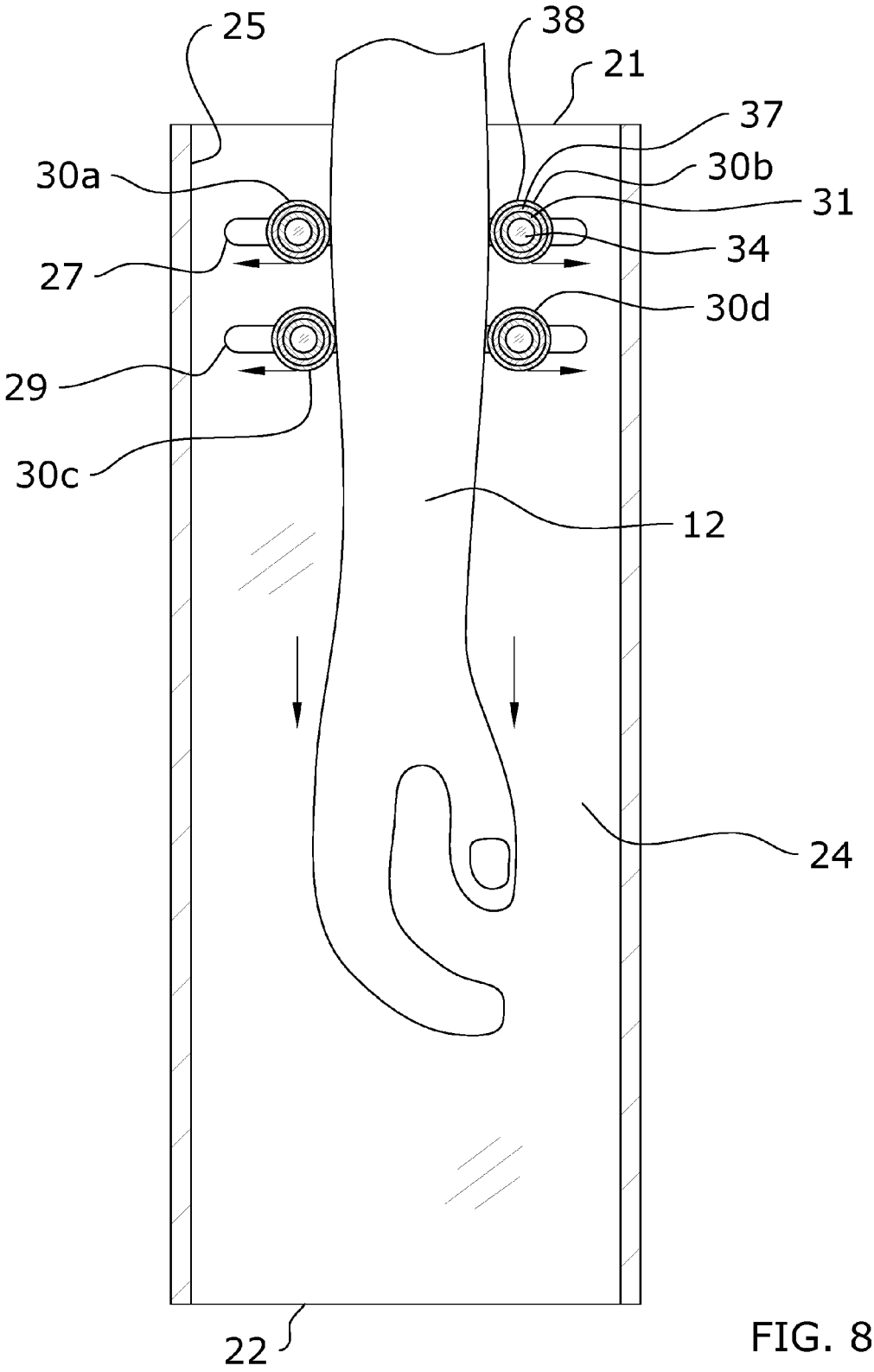
FIG. 8 is a side sectional view of the present invention.

The user of the present invention may now begin usage of the arm therapy device 10. The limb 12, such as an arm as shown in the figures, is lowered through the upper opening 25 of the housing 20 as shown in FIG. 3. As the limb 12 is pushed downwardly as shown in FIG. 8, it will pass between the rollers 30 and force the rollers 30 away from each other. As the rollers 30 are forced away from each other, the outer tube 37 of each roller 30 will rotate with respect to the corresponding inner tube 31 of each roller 30. The inward bias force of the bias members 50 will push the rollers 30 toward each other, causing them to exert pressure on the limb 12 as it passes therethrough.

The operator of the present invention may advance and reverse their limb 12 into and out of the housing 20 to pass the rollers 30 over the affected area multiple times in multiple directions. The force of the rollers 30 against the limb 12 will provide treatment to alleviate or prevent repetitive stress injuries such as carpal-tunnel syndrome. When completed with treatment, the limb 12 may be removed from the housing 20 through its upper opening 25, with the rollers 30 retaining their resting position against each other.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An arm therapy device, comprising:

a housing comprising an upper end, a lower end, a first side, a second side, and an upper opening;

a first slot extending across the first side of the housing;

a second slot extending across the second side of the housing;

a first roller movably positioned within the first slot and the second slot such that the first roller extends between the first side and the second side of the housing;

a first collar connected to the first roller, the first collar being positioned externally with respect to the housing, wherein the first collar comprises a first threaded connector, the first threaded connector being threadably and removably connected to the first roller;

a second roller movably positioned within the first slot and the second slot such that the second roller extends between the first side and the second side of the housing;

a second collar connected to the second roller, the second collar being positioned externally with respect to the housing, wherein the second collar comprises a second threaded connector, the second threaded connector being threadably and removably connected to the second roller; and a bias member connected between the first collar and the second roller collar such that the first roller and the second roller are each biased toward each other.

2. The arm therapy device of claim 1, wherein the first roller and the second roller extend horizontally across the housing.

3. The arm therapy device of claim 1, wherein the first roller and the second roller extend diagonally across the housing.

4. The arm therapy device of claim 1, wherein the bias member comprises a resistance band.

5. The arm therapy device of claim 1, wherein the housing comprises an elongated rectangular configuration.

6. The arm therapy device of claim 1, wherein the housing is adapted to be freestanding on the lower end of the housing.

7. The arm therapy device of claim 1, wherein the first roller and second roller are positioned internally with respect to the housing.

8. The arm therapy device of claim 7, wherein the first collar includes a first connector and the second collar includes a second connector, wherein the first connector and the second connector each extend through the first slot to connect the first connector with the first roller and the second connector with the second roller.

9. The arm therapy device of claim 1, wherein the first collar includes a first groove and the second collar includes a second groove.

10. The arm therapy device of claim 9, wherein the bias member comprises a resistance band, wherein the resistance band is connected between the first groove of the first collar and the second groove of the second collar.

11. An arm therapy device, comprising:

a housing comprising an upper end, a lower end, a first side, a second side, and an upper opening;

a first slot extending across the first side of the housing;

a second slot extending across the second side of the housing;

a first roller movably positioned within the first slot and the second slot such that the first roller extends between the first side and the second side of the housing;

a second roller movably positioned within the first slot and the second slot such that the second roller extends between the first side and the second side of the housing, wherein the first roller includes a first threaded opening and wherein the second roller includes a second threaded opening;

a first collar connected to the first roller;

a second collar connected to the second roller, wherein the first collar includes a first connector and the second collar includes a second connector, wherein the first connector and the second connector each extend through the first slot to connect the first connector with the first roller and the second connector with the second roller, wherein the first connector is threadably engaged with the first threaded opening and wherein the second connector is threadably engaged with the second threaded opening; and a bias member connected between the first collar and the second collar such that the first roller and the second roller are each biased toward each other.

12. The arm therapy device of claim 11, wherein the first collar is removably connected to the first roller and the second collar is removably connected to the second roller.

13. The arm therapy device of claim 11, wherein the first collar includes a first groove and the second collar includes a second groove.

14. The arm therapy device of claim 13, wherein the bias member comprises a resistance band, wherein the resistance band is connected between the first groove of the first collar and the second groove of the second collar.

15. An arm therapy device, comprising:

a housing comprising an upper end, a lower end, a first side, a second side, and an upper opening;

a first upper slot extending across the first side of the housing;

a second upper slot extending across the second side of the housing;

a first lower slot extending across the first side of the housing below the first upper slot;

a second lower slot extending across the second side of the housing below the second upper slot;

a first roller movably positioned within the first upper slot and the second upper slot such that the first roller extends between the first side and the second side of the housing, wherein the first roller includes a first threaded opening;

a second roller movably positioned within the first upper slot and the second upper slot such that the second roller extends between the first side and the second side of the housing, wherein the second roller includes a second threaded opening;

a third roller movably positioned within the first lower slot and the second lower slot such that the third roller extends between the first side and the second side of the housing;

a fourth roller movably positioned within the first lower slot and the second lower slot such that the fourth roller extends between the first side and the second side of the housing;

a first collar connected to the first roller, wherein the first collar includes a first connector which extends through the first slot to connect the first connector with the first roller;

a second collar connected to the second roller, wherein the second collar includes a second connector which extends through the first slot to connect the second connector with the second roller, wherein the first connector is threadably engaged with the first threaded opening and wherein the second connector is threadably engaged with the second threaded opening;

a third collar connected to the third roller;

a fourth collar connected to the fourth roller;

a first bias member connected between the first roller and the second roller such that the first roller and the second roller are each biased toward each other; and a second bias member connected between the third roller and the fourth roller such that the third roller and the fourth roller are each biased toward each other.

16. The arm therapy device of claim 15, wherein the housing is transparent.

* * * * *